US005685273A

United States Patent [19]

Johnson et al.

[11] Patent Number: 5,685,273

[45] Date of Patent: Nov. 11, 1997

[54] METHOD AND APPARATUS FOR CONTROLLING FUEL INJECTION IN AN INTERNAL COMBUSTION ENGINE

[75] Inventors: William P. Johnson, Valley Center; Niels J. Beck, Bonita; James A. Peña, Leucadia, all of Calif.

[73] Assignee: BKM, Inc., San Diego, Calif.

[21] Appl. No.: 692,241

[22] Filed: Aug. 7, 1996

[51] Int. Cl.[6] ..... F02M 41/00

[52] U.S. Cl. ..... 123/446; 123/467; 123/506; 239/96

[58] Field of Search ..... 123/446, 447, 123/467, 506, 496, 501; 239/88, 96, 585.1

[56] References Cited

U.S. PATENT DOCUMENTS

| | | | |
|---|---|---|---|
| Re. 33,270 | 7/1990 | Beck et al. | 123/447 |
| 1,863,232 | 6/1932 | Woolson . | |
| 1,890,702 | 12/1932 | Steiner . | |
| 1,919,286 | 7/1933 | Woolson . | |
| 2,000,555 | 5/1935 | Becker | 123/139 |
| 2,771,867 | 11/1956 | Riliaucourt | 123/112 |
| 2,985,378 | 5/1961 | Falberg | 239/96 |
| 3,464,627 | 9/1969 | Huber | 239/96 |
| 3,777,977 | 12/1973 | Regneault et al. | 239/96 |
| 4,015,571 | 4/1977 | Stumpp | 123/139 |
| 4,040,395 | 8/1977 | Demetrescu | 123/32 |
| 4,498,625 | 2/1985 | Schechter | 239/88 |
| 4,509,488 | 4/1985 | Forster et al. | 123/481 |
| 4,798,186 | 1/1989 | Ganser | 123/467 |
| 4,807,811 | 2/1989 | Aketa et al. | 239/96 |
| 4,909,440 | 3/1990 | Mitsuyasu et al. | 239/96 |
| 4,993,637 | 2/1991 | Kanesaka | 239/96 |
| 5,042,718 | 8/1991 | Bergmann et al. | 239/88 |
| 5,048,489 | 9/1991 | Fischer et al. | 123/467 |
| 5,161,496 | 11/1992 | Matsushima et al. | 123/185.3 |
| 5,176,120 | 1/1993 | Takahashi | 123/467 |
| 5,235,954 | 8/1993 | Sverdlin | 123/467 |
| 5,339,786 | 8/1994 | Martin | 123/467 |
| 5,438,968 | 8/1995 | Johnson et al. | 123/446 |
| 5,441,029 | 8/1995 | Hlousek | 239/96 |
| 5,460,329 | 10/1995 | Sturman | 239/96 |
| 5,522,364 | 6/1996 | Knight et al. | 123/506 |
| 5,526,790 | 6/1996 | Augustin et al. | 123/506 |
| 5,551,634 | 9/1996 | Raab et al. | 239/96 |
| 5,577,892 | 11/1996 | Schittler et al. | 123/506 |

FOREIGN PATENT DOCUMENTS

WO 95/09979 4/1995 WIPO .

OTHER PUBLICATIONS

A Gas–Generator Tubrocompound Engine, Ralph J. Hooker, General Electric Co., 1956.

Detroit Diesel Electronic Control, R.J. Hames, R.D. Straub, R.W. Amann Paper No. 850542.

Study of a Small Two–Stroke Engine with Low–Pressure Air–Assisted Direct–Injection System Huei–Huang, Yu–Yin Peng, Ming–Hong Jeng, and James H. Wang, SAE Technical Paper No. 912350.

Improvment of Irregular Combustion of Two–Stroke Engine by Skip Injection Control, Huang et al. SAE Technical Paper Series, Paper No. 922310, 1992.

Improvement of Exhaust Emissions from a Two–Stroke Engine by Direct Injection System, Huang et al. Paper No. 930497, 1993.

*Primary Examiner*—Thomas N. Moulis
*Attorney, Agent, or Firm*—Nilles & Nilles, S.C.

[57] ABSTRACT

Fuel delivery to an engine from a cyclically pressurizable, electronically controlled accumulator-type fuel injector is controlled by "wasting" at least a portion of the pressurization stroke of the engine's high pressure pump so that a designated portion of the pressurization stroke of the pump does not result in accumulator cavity pressurization. Metering is effected simply by extending the period that the system's existing solenoid vent valve is open into a portion of the succeeding pressurization stroke of the pump so that a portion of the pumped fuel flows directly to vent. Additional electrical load on the engine can be minimized by using a latching type solenoid valve as the vent valve. The metering scheme 1) is more precise than metering schemes heretofore available for injectors of the disclosed type, 2) does not adversely effect injection timing or other injection parameters, 3) and requires no additional hardware.

19 Claims, 6 Drawing Sheets

METHOD AND APPARATUS FOR CONTROLLING FUEL INJECTION IN AN INTERNAL COMBUSTION ENGINE

BACKGROUND OF THE INVENTION

1. Field of the Invention

The invention relates to fuel injector apparatus and method and, more particularly, to an improved control system and method for metering the fuel supply to internal combustion engines. The invention is particularly well suited for use in relatively small two-cycle internal combustion engines fueled by a mechanically pressurized, electronically controlled accumulator-type fuel injector.

2. Description of the Related Art

Relatively small two-cycle engines are widely utilized throughout the world in weed trimmers, leaf blowers, chain saws, small tillers, small generators, liquid pumps, jet skis, mopeds, motorbikes, and the like. Such engines are normally piston-ported one-cylinder engines which are gasoline fueled through a carburetor.

Two cycle engines in the field today are serious emitters of hazardous atmospheric pollutants and are the subject of increased worldwide scrutiny. Exhaust emission standards proposed by the State of California, as well as various other domestic and foreign government agencies, may well prevent the use of two-cycle engines with current technology. The need therefore has arisen to provide a cost effective two-cycle engine which exhibits drastically reduced emissions when compared to standard two-cycle engine design.

A two-cycle engine having an electronically controlled accumulator type fuel injection system designed to meet this goal is disclosed in U.S. Pat. No. 5,438,968 (the '968 patent), which was filed in the name of the inventors named in the present application and which was assigned to the Assignee of the present application. The '968 patent describes a two-cycle engine fueled by an electronically controlled accumulator type fuel injection system. The quantity of fuel delivered during each injection cycle is defined by the following relationship:

$$Q=K\times V_{ac}\times(P_{max}-P_{min}) \qquad \text{Eq.1}$$

where:

Q is the quantity of fuel that is metered and then injected into the combustion chamber during an injection event;

K is the compressibility factor for the fuel;

$V_{AC}$ is the accumulator volume;

$P_{MAX}$ is the maximum or peak pressure in the accumulator cavity during an injection event; and $P_{MIN}$ is the minimum pressure in the accumulator cavity.

As discussed in some length in the '968 patent, precise control of fuel supply to the engine is an important consideration in reducing emissions and controlling engine load. Several methods for controlling or metering fuel delivery to the engine are disclosed in the '968 patent, but all exhibit some drawbacks.

For instance, the '968 patent describes skip-fire, or intermittent injection sequences. This method varies engine power by injecting the same, maximum fuel quantity during each injection cycle while skipping one or more fueling and firing sequences between each injection cycle. While this method provides for control of engine power from part load to full load, changes in power are incremental or stepped so that there are limits to the precision with which engine power can be controlled. Stated another way, control of engine power cannot be "fine tuned".

Another technique disclosed in the '968 patent is to vary the delivery of fuel to the engine to vary the maximum accumulator pressure, $P_{MAX}$, at the moment of injection by one of three methods, each of which exhibits its own drawbacks.

The first such method is to time the injection event to begin at a specified moment during the pump pressurization cycle. The moment of injection is determined by the motion of the pump plunger. This method provides relatively precise control of fuel delivery, but results in variations in injection timing, which often results in a timing position which is not optimized for efficient combustion, minimum fuel consumption, and minimum exhaust emissions.

The second method for controlling $P_{MAX}$ involves setting a pressure release control valve to limit $P_{MAX}$ to a predetermined value. While this method provides a level of safety by preventing over pressure, and also provides some control of fuel delivery to define a maximum power setting, it does not provide for fuel delivery control under engine part-load conditions. This in turn results in improper fuel-air ratio and inferior combustion quality during part load and engine transient operations.

Finally, the '968 patent discloses controlling $P_{MAX}$ by controlling a supply transfer pump pressure which supplies fuel to the main high pressure pump. This method provides only a limited range of pressure control and complicates the entire engine by requiring the incorporation of a low pressure control mechanism into the system.

Many references discuss other systems which meter the quantity of fuel delivery to an engine. Representative of such systems are "pulse width metered" (PWM) systems. PWM systems are characterized by the control of fuel injection quantity by controlling the amount of time that fuel is injected into the engine. For instance, some low pressure gasoline fuel injectors used for injecting gasoline into the intake air manifold of an automobile engine use PWM. In these low pressure gasoline fuel injection systems, the quantity of fuel injected in each cycle is proportional to the period of time that a solenoid valve is open to expose the nozzle to a constant pressure provided by a common fuel rail.

Another example of a pulse width metering system is that proposed by the Detroit Diesel DDEC System as disclosed in SAE Paper No. 850852. In the DDEC system, the flow of fuel to and from a nozzle is controlled at least in part by a solenoid valve which can be opened to vent the fuel source. The quantity of fuel injected is proportional to the total period of time that the solenoid valve is closed and to which the fuel injector nozzle is exposed to pressurized fuel. Valve closure initiates pressurization and injection, and valve opening causes injection pressure decay and termination of the injection event. The quantity of fuel injected is proportional to the period of valve closure relative to the period of valve opening.

These PWM control schemes are not readily applicable to a single engine cycle of an accumulator type fuel injectors in which the quantity of fuel injected during an injection event is determined by accumulator pressure at the time that injection commences rather than the time that the injector is energized.

The need has therefore arisen to tailor a fuel metering control scheme to a fuel injection system and method suitable for use on relatively small two-cycle engines.

OBJECTS AND SUMMARY OF THE INVENTION

A first primary object of the invention therefore is to provide an improved method of metering the fuel supply to an injector of an internal combustion engine without adversely affecting injection timing and without increasing the complexity of the engine.

In accordance with a first aspect of the invention, this object is achieved by reciprocating the engine's fuel pump to undergo successive pumping cycles, each pumping cycle consisting of a pressurization stroke followed by a depressurization stroke. The pump forces fuel into the fuel supply conduit and the cavity during pressurization strokes thereof and permits backflow from the fuel supply conduit towards the output during depressurization strokes thereof. A first injection event, occurring during a first pumping cycle, is initiated by venting the cavity. The quantity of fuel injected during a second injection event occurring during a second pumping cycle, occurring immediately following the first pumping cycle, is selected by continuing to vent the cavity for a designated portion of the pressurization stroke of the second cycle, the designated portion 1) including a time at which the pressurization stroke begins and 2) varying generally inversely with a quantity of fuel to be injected during the second injection event.

Preferably, the venting step comprises energizing a solenoid of a solenoid vent valve, disposed in an outlet conduit in fluid communication with the cavity, to open the solenoid valve and permit fuel flow therethrough.

In applications in which power drain on the engine's electrical system is not a concern, the solenoid vent valve can be a non-latching solenoid valve, in which case the method would entail maintaining current flow to the solenoid of the valve for the entire time that the valve is open and then de-energizing the solenoid to close the valve at the end of the designated portion.

In applications in which power drain on the engine's electrical power system is to be minimized, the solenoid vent valve is preferably a latching solenoid valve, in which case the energizing step comprises supplying a current pulse to the solenoid of the valve, and the valve remains open after termination of the current pulse. Closing the valve at the end of the designated portion is achieved by supplying a second current pulse to the solenoid.

A second primary object of the invention therefore is to provide an improved apparatus for metering the fuel supply to an injector of an internal combustion engine.

In accordance with another aspect of the invention, this object is achieved by providing a fuel injector which includes an injector body having a pressurized fuel inlet and having a discharge orifice communicating with the cylinder, and a nozzle needle slidably disposed in the nozzle body and being spring biased towards a position preventing fuel flow out of the discharge orifice. A fuel supply conduit is in fluid communication with the pressurized fuel inlet of the injector body and has an inlet. A reciprocating pump has an input operatively connected to the fuel source and has an output connected to the inlet of the fuel supply conduit. The pump operates in pumping cycles with each cycle consisting of a pressurization stroke followed by a depressurization stroke, and the pump forces fuel into the fuel supply conduit during pressurization strokes thereof and permits backflow from the fuel supply conduit towards the output during depressurization strokes thereof. A solenoid vent valve is in fluid communication with the fuel supply conduit and with vent and, when energized, places the fuel supply conduit in fluid communication with vent. Means such as an electronic control unit (ECU) are provided for 1) opening the solenoid vent valve to initiate a first injection event occurring during a first pumping cycle and for 2) maintaining the solenoid vent valve in the open position for a designated portion of a pressurization stroke of a second pumping cycle occurring immediately following tile first pumping cycle, the designated portion including the beginning of the pressurization stroke and varying generally inversely with a quantity of fuel to be injected during a second injection event occurring as a result of the second pumping cycle.

Preferably, the fuel injector is an accumulator-type fuel injector having an accumulator cavity in fluid communication with the fuel inlet of the fuel injector and having a control cavity. The accumulator cavity is located so that fuel pressure therein imposes an opening force on the needle, the control cavity being located so that fuel pressure therein imposes a closing force on the needle. An outlet conduit is in fluid communication with the control cavity, the solenoid vent valve, and the fuel supply conduit. The control cavity has a first opening and has a second opening connected to the outlet conduit. An accumulator cavity feed conduit connects the inlet of the fuel injector to the fuel supply conduit, and a control cavity feed conduit connects the first opening of the control cavity to the fuel supply conduit.

Other objects, features, and advantageous of the invention will become apparent to those skilled in the art from the following detailed description and the accompanying drawings. It should be understood, however, that the detailed description and specific examples, while indicating preferred embodiments to the present invention, are given by way of illustration and not of limitation. Many changes and modifications may be made within the scope of the present invention without departing from the spirit thereof, and the invention includes all such modifications.

BRIEF DESCRIPTION OF THE DRAWINGS

These and other objects and advantages of the invention will become more apparent from the following Detailed Description and the accompanying drawings, wherein.

DETAILED DESCRIPTION OF THE PREFERRED EMBODIMENT

1. Resume

Pursuant to the invention, fuel delivery to an engine from a cyclically pressurizable, electronically controlled accumulator-type fuel injector is controlled by "wasting" at least a portion of the pressurization stroke of engine's high pressure pump so that a designated portion of the pressurization stroke of the pump does not result in accumulator cavity pressurization. Metering is effected simply by extending the period that the system's existing solenoid vent valve is open into a portion of the succeeding pressurization stroke of the pump so that a portion of the pumped fuel flows directly to vent. Additional electrical load on the engine can be minimized by using a latching type solenoid valve as the vent valve. The metering scheme 1) is more precise than metering schemes heretofore available for injectors of the disclosed type, 2) does not adversely effect injection timing or other injection parameters, 3) and requires no additional hardware.

2. Injector Construction

Two-stroke (hereinafter "two-cycle") fuel-injected internal combustion engines embodying the features of the present invention may be provided in several different optional forms. Two-cycle engines according to the invention may be either spark ignited or compression ignited, spark-ignited engines normally being gasoline fueled, but alternatively fueled by a gaseous fuel such as natural gas, methane, ethane, propane or butane; while compression-ignited two-cycle engines according to the invention will normally be diesel fueled.

The present invention has been developed primarily for small utility-type two-cycle engines, although it is to be understood that the invention is not limited to any particular size two-cycle engine. Examples of some uses currently contemplated for two-cycle engines embodying the present invention, which are given by way of example only and not of limitation, are engines for nylon line weed trimmers, leaf blowers, chain saws, small tillers, small generator sets, liquid pumps for pumping diesel fuel or JP-5 or JP-8 aircraft jet engine fuels, jet skis, motorbikes and the like. The forms of the invention shown and described hereinafter in detail are gasoline-fueled, spark-ignited engines, although as stated above, the invention is not so limited.

Figure 1:
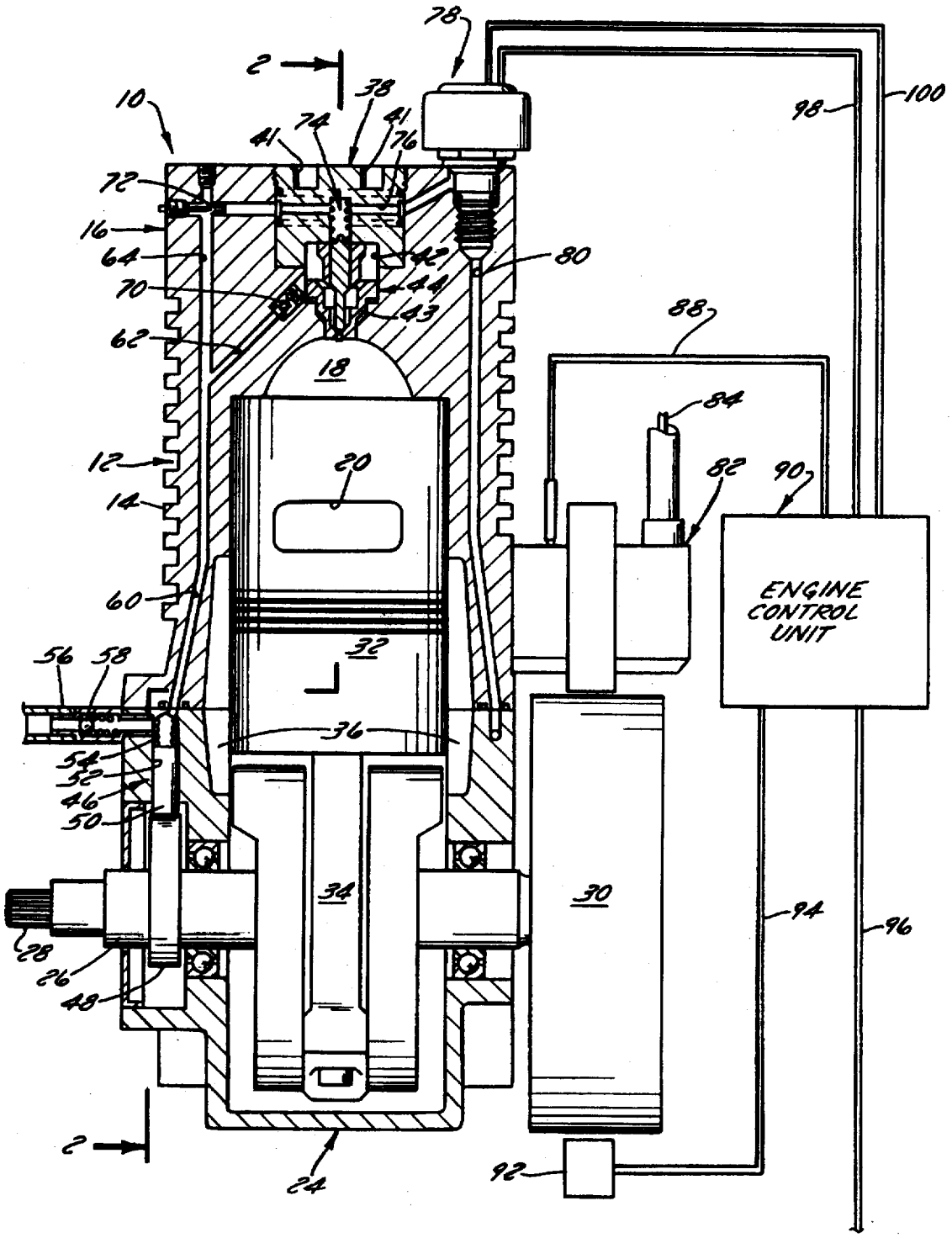
FIG. 1 is a primarily vertical, axial section taken on the line 1—1 of FIG. 2, with portions in elevation and portions diagrammatically shown, illustrating a two-cycle ignition fired engine according to the invention.
Figure 2:
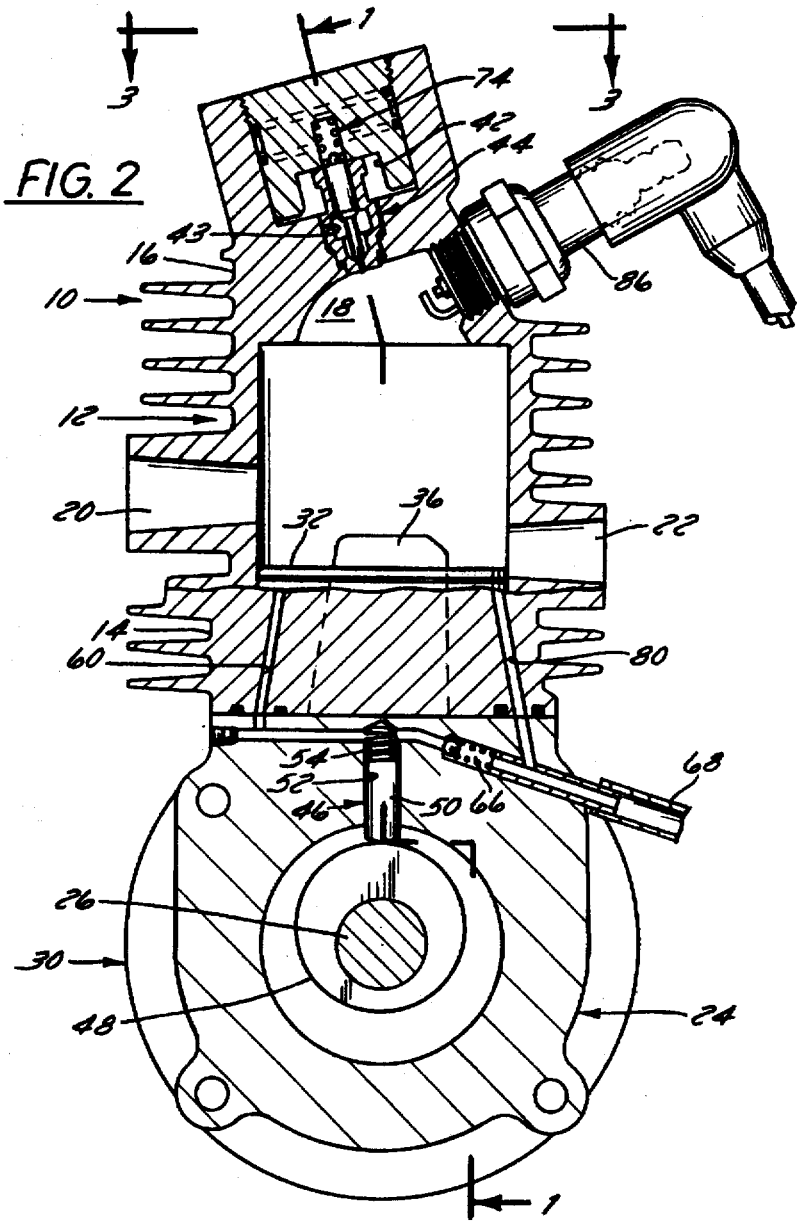
FIG. 2 is a vertical section, with portions in elevation, taken on the line 2—2 in FIG. 1.
Figure 3:
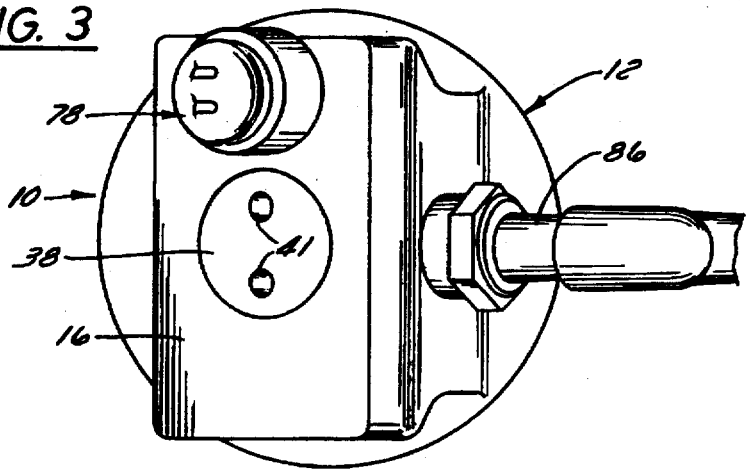
FIG. 3 is a top plan view of the engine taken on the line 3—3 in FIG. 2.

Referring at first to FIGS. 1–3, engine 10 has a unitary body 12, preferably an aluminum casting, comprising a cylinder 14 and head 16, head 16 defining combustion chamber 18. Transversely elongated exhaust port 20 extends through the wall of cylinder 14 as best seen in FIG. 2, and also seen in FIG. 1, and diametrically opposed transversely elongated intake port 22 extends through the wall of cylinder 14 axially displaced below exhaust port 20 as seen in FIG. 2. The presently preferred relative locations of exhaust port 20 and intake port 22 are explained in detail hereinafter relative to operation of engine 10.

Crankcase 24 is generally conventionally attached and sealed to the bottom of cylinder 14. Crankshaft 26 is rotatably mounted in suitable lubricated bearings in opposite walls of crankcase 24, and extends through one crankcase wall to a power output end portion 28, and through the opposite crankcase wall for supporting an external flywheel 30. A conventional small utility two-cycle engine piston 32 is axially slideable in cylinder 14, on its downstrokes rotatably driving crankshaft 26 through connecting rod 34. A pair of axially elongated, diametrically opposed air scavenge or transfer port recesses 36 is provided within cylinder 14 and crankcase 24, piston 32 operating in the conventional two-cycle engine manner to compress ignition air within crankcase 24 during its downstroke, releasing this compressed air through scavenge ports 36 proximate the bottom of its downstroke where it uncovers the upper ends of scavenge ports 36 as seen in both FIG. 1 and FIG. 2; the piston then compressing this transferred air within cylinder 14 and combustion chamber 18 during its succeeding compression upstroke, while at the same time producing a partial vacuum within crankcase 24; piston 32 then uncovering air intake port 22 below the piston skirt as piston 32 approaches the top of its compression stroke so that the partial vacuum in crankcase 24 and the lower portion of cylinder 14 will cause aspiration of air through intake port 22 into the lower portion of cylinder 14 and crankcase 24 for compression during the next downstroke of piston 32. Thus, in the usual two-cycle manner, piston 32 serves not only to provide mechanical power to crankshaft 26 during its downstroke after ignition of the fuel/air charge, but as an air pump for the air portion of the fuel/air ignition mixture. Alternatively, scavenge ports 36 may be omitted, and the ignition air may be pumped into cylinder 14 through intake port 22 by external air pump means (not shown).

Figure 4:
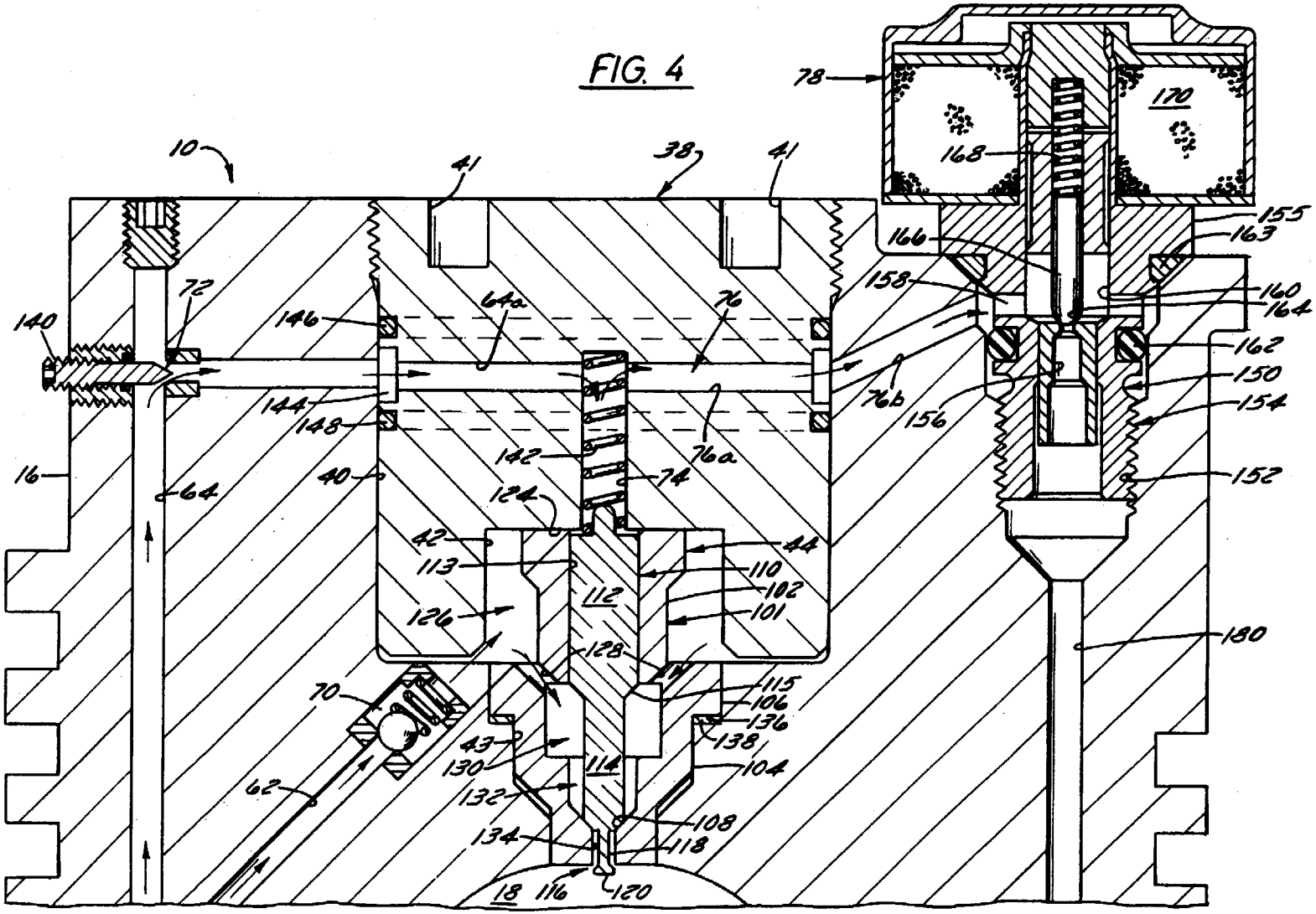
FIG. 4 is a greatly enlarged fragmentary, vertical axial section, with portions in elevation, showing internal details of the engine head construction, including details of the accumulator fuel injector, hydraulic control for the injector, and two-way solenoid valve, for the fuel injector illustrated in FIGS. 1–3.
Figure 5:
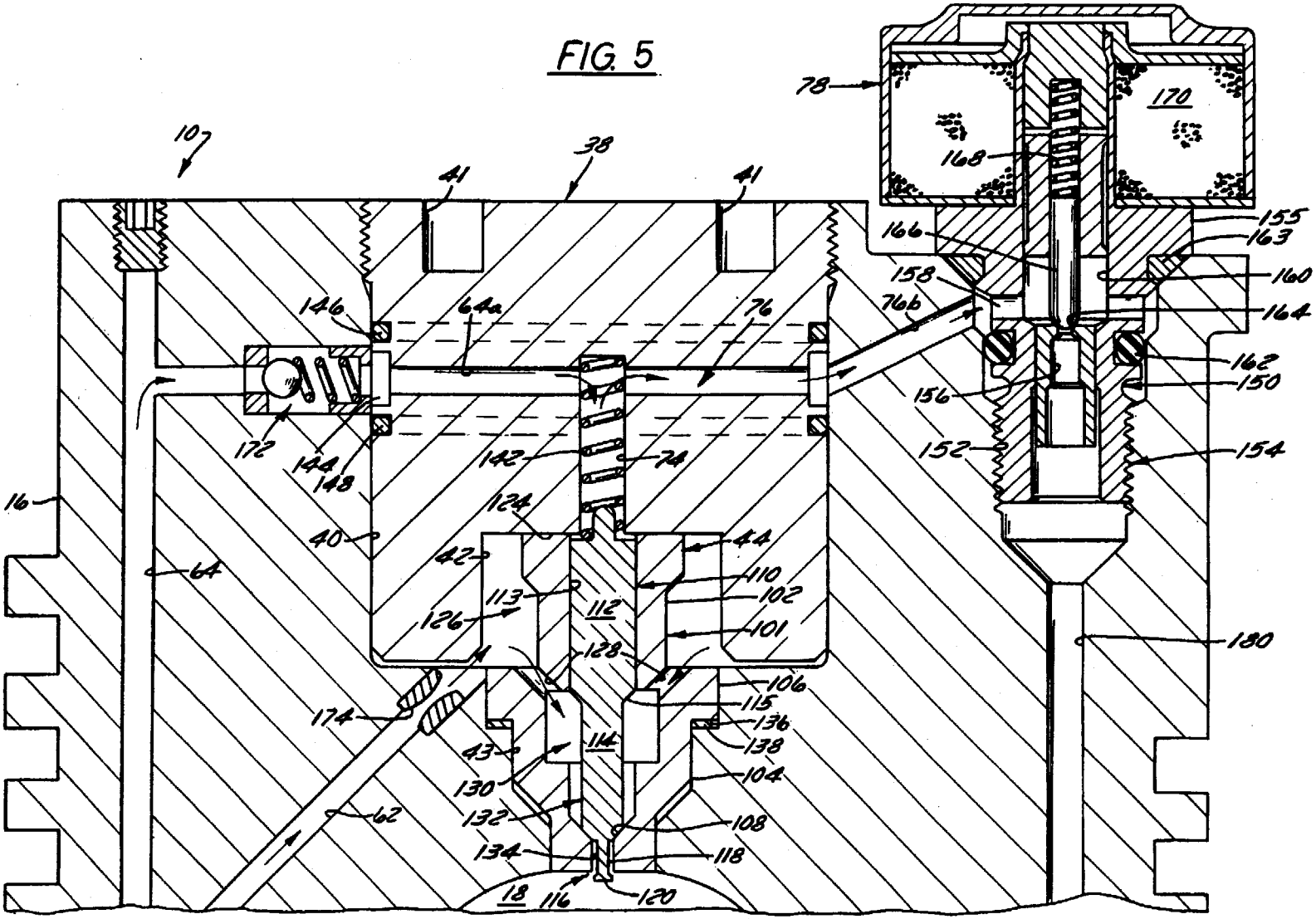
FIG. 5 is a diagrammatic illustration of the fuel injector shown in FIGS. 1–4, including the fuel tank and electrical circuitry for powering the ECU and energizing the solenoid valve.

An externally threaded annular plug 38 is threadedly engaged within a complementary internally threaded annular recess 40 in head 16 (see FIG. 4). A pair of upwardly opening wrenching holes 41 is provided in annular plug 38. A downwardly opening annular recess 42 is provided in the lower portion of threaded plug 38. A stepped annular bore 43 extends through head 16 below head recess 40 in axial alignment with and of smaller diameter than plug recess 42. Accumulator-type fuel injector 44 has its lower portion seated within stepped annular head bore 43 so as to expose the lower end of fuel injector 44 to combustion chamber 18; the upper portion of fuel injector 44 being received within plug recess 42, with injector 44 being clamped in its seated position within stepped bore 43 by the downwardly facing surface in the top of plug recess 42. Details of fuel injector 44 and threaded plug 38 are best shown in FIGS. 4 and 5, and will be described in detail below in connection with FIG. 4.

As seen in FIGS. 1 and 2, a high pressure pump, generally designated 46, for fueling injector 44 and pressurizing the injector needle spring cavity is powered by an eccentric cam lobe 48 on crankshaft 26. For engines according to the invention which are spark ignited and either gasoline fueled or hydrocarbon gas fueled, typical peak pressures for high pressure pump 46 will be on the order of about 1,000–2,000 psi, but may be lower or higher for particular applications. For compression ignition engines according to the invention, such as diesel fueled engines, the peak pressure of high pressure 46 will be much higher, e.g., on the order of about 4,000–20,000 psi.

Pump 46 employs a reciprocating plunger 50 which reciprocates in a plunger cavity 52 in the wall of crankcase 24 according to the contour of eccentric cam lobe 48. Pump plunger 50 is moved upwardly by cam lobe 48 in its compression stroke, and moved downwardly in its intake stroke by means of plunger return spring 54 within cavity 52. Pump 46 receives fuel from a fuel tank through a low pressure intake conduit 56, which has a check valve 58 in it to prevent fuel backflow during compression strokes of plunger 50. Fuel may be supplied to pump 46 through intake conduit 56 at substantially atmospheric pressure; or may be further pressurized to avoid intake cavitation at high speed engine operation, or alternatively for power variability. Pressurized fuel is delivered by pump 46 through a high pressure output conduit or fuel supply conduit 60 which divides into two branches, an accumulator cavity feed conduit 62 and an injector spring cavity feed conduit 64. A pump output pressure relief valve 66 communicates with the head of plunger cavity 52 as seen in FIG. 2, and as described in detail in connection with the diagrammatic illustration of FIG. 5. Pressure relief valve 66 is preferably set to open before top dead center (TDC) of pump plunger 50 so that pressure relief valve 66 positively controls the pressure of fuel delivered to the accumulator cavity and the injector needle spring cavity to a preset or adjusted amount, as described in more detail hereinafter. The overflow fuel output from relief valve 66 is returned to the fuel tank through a return conduit 68 seen in FIGS. 2 and 5.

The illuminated embodiment includes a check valve 70 in accumulator cavity feed conduit 62 such that the fuel pressure within the accumulator cavity of injector 44 will, during each pressure stroke of pump plunger 50, reach the pressure level established by pump output relief valve 66 and retain such pressure until injection. Injector spring cavity feed conduit 64 preferably has a restrictive orifice 72 in it to restrict backflow from the spring cavity toward pump 46 if injection is timed to occur after TDC of pump plunger 50 for reasons described hereinafter. Orifice 72 may be manually adjustable for calibration purposes.

The injector spring cavity is generally designated 74, and is normally referred to by applicants as the injector control cavity since release of pressure from within cavity 74 controls the timing of each injection event relative to; engine crank angle. Control cavity 74 has a high pressure outlet conduit 76 which leads to a normally-closed two-way solenoid valve 78. Energization of solenoid valve 78 to open it causes communication between control cavity outlet conduit 76 and a solenoid valve vent conduit 80 which leads back to the fuel tank, thereby releasing pressure from within control cavity 74 to precipitate an injection event. Details of injector control cavity 74, its feed conduit 64, its high pressure outlet conduit 76, and two-way solenoid valve 78 are shown in FIGS. 4 and 5, and will be described in connection with FIG. 4.

Engine 10 is shown in the drawings as having a conventional ignition system for a small two-cycle utility engine, although it is to be understood that alternatively a separate generator and spark coil may be employed. Referring to FIG. 1, the ignition system embodies a magneto generally designated 82 which is energized by one or more permanent magnets peripherally embedded in flywheel 30. Magneto 82 has primary and secondary windings, the secondary winding high voltage output being conducted through a spark plug cable 84 leading to a conventional sparkplug 86 seen in FIGS. 2 and 3. The primary winding or a separate charging coil in magneto 82 has a low voltage output conductor 88 which electrically powers an engine control unit (ECU) 90, in which the primary or charging coil electrical output is rectified to power the ECU functions described hereinafter. A Hall effect magnetic engine speed and position sensor 92 is actuated by the embedded magnet or magnets in flywheel 30, and is electrically connected to ECU 90 through a conductor 94. An engine load command input conductor 96 to ECU 90 may be either digital or analog, and can be trigger actuated. The functions of engine load command input conductor 96 will be described hereinafter in detail. Intermittent electrical power is furnished to solenoid valve 78 through conductors 98 and 100.

Referring now particularly to FIG. 4, fuel injector 44 has a unitary cylindrical body 101 consisting of an upper needle guide portion 102 and a lower nozzle portion 104. Body 101 has an axial locating flange 106 for locating injector body 101 within the stepped annular head bore 43. An upwardly and inwardly facing frusto conical needle seat 108 is provided in injector body nozzle portion 104.

The injector needle is generally designated 110, and includes a radially enlarged upper needle portion 112 which has a slideable, sealing fit within a complementary axial bore 113 in needle body guide portion 102, and a reduced lower needle portion 114 which in the lowermost position of needle 110 seats against needle seat 108. There is a bevel transition 115 between needle portions 112 and 114.

While any conventional injector nozzle may be employed in connection with the present invention, applicants have found that a "pintle nozzle" has particularly good spray characteristics for efficient combustion in small two-cycle engines. Such a pintle nozzle is illustrated in FIG. 4, and is generally designated 116. This pintle nozzle includes a small-diameter lower end shank portion 118 of needle 110 which is further reduced from lower needle portion 114, with an enlarged pintle head 120 at the lower end of reduced shank portion 118. This pintle head 120 has a generally upwardly facing frusto-conical surface which variably deflects the fuel spray somewhat radially outwardly in combustion chamber 18, which is useful in developing a "stratified charge" during an injection event, as described in detail hereinafter.

The downwardly opening annular recess 42 in threaded plug 38 has a downwardly facing upper end surface 124 which engages the top of injector body 101 to secure body 101 in its seated location in stepped head bore 43. Annular recess 42 in plug 38 and the bottom of head recess 40 define a primary accumulator cavity 126 of injector 44. A plurality of regularly annularly spaced flow channels 128 in injector body 101 lead from primary accumulator cavity 126 to a smaller secondary accumulator cavity 130 within injector body 101, which in turn leads to a diametrically reduced outlet cavity 132 and thence past needle seat 108 to pintle spray orifice 134. Downwardly facing shoulder 136 on injector body flange 106 seats against a sealing gasket 138 which is supported on the first upwardly facing step of stepped head bore 43, and threaded plug 38 is torqued down so as to provide a tight seal at gasket 138.

Referring now to the fuel hydraulic circuit for injector control cavity 74 in plug 38, adjustment for orifice 72 in control cavity feed conduit 64 is provided by an adjusting screw 140. A continuing part of the control cavity feed conduit 64 is a feed conduit portion **64*a* in threaded plug 38 which leads to control cavity 74. Control cavity high pressure outlet conduit 76 is in two continuing sections, a first section 76*a* within threaded plug 38, and a section 76*b* within head 16 which leads to solenoid valve 78. The spring within cavity 74 is generally designated 142, and is shown as a helical compression spring compressed between the top of needle 110 and threaded plug 38. An annular groove 144 in the periphery of plug 38 renders alignment of primary cavity feed conduit 64 with its continuation 64*a* and of high pressure outlet conduit section 76*a* with section 76*b* uncritical. The hydraulic fuel circuit for control cavity 74 is sealed by peripheral O-ring seals 146 and 148 in plug 38 on opposite sides of annular groove 144**.

Still referring to FIG. 4, details of solenoid valve 78 will now be described. Valve 78 has a generally annular, tubular body 150 which is received within a generally complementary annular upwardly opening cavity 152 in the head casting. Valve body 150 has an externally threaded lower portion 154 which is threadedly engaged within a complementary internally threaded lower section of head cavity 152. Body 150 has a hex head 155 at its upper end for screwing body 150 into position within cavity 152. An axial vent passage 156 extends downwardly through the lower portion of valve body 150 into communication with valve vent conduit 80 which extends downwardly through the head casting; and leads to the fuel tank.

Valve body 150 has a transverse high pressure inlet passage 158 in its upper portion which is in communication with control cavity high pressure outlet conduit portion 76b, inlet passage 158 leading to an axial high pressure cavity 160 within body 150. A pair of O-ring seals 162 and 163 provides appropriate sealing for the communication between high pressure conduit section 76b and inlet passage 158, as well as high pressure cavity 160. Annular valve vent port 164 defines communication between high pressure cavity 160 and vent passage 156, and is normally closed by the hemispherically rounded lower end of valve pin 166 which is normally downwardly biased to the closed position by means of valve spring 168 above pin 166. Solenoid coil 170 is located at the top of valve 78, and is normally deenergized. Energization of coil 170 lifts pin 166 off of valve seat 164 to permit rapid escape of pressurized fuel from control cavity 74 through outlet conduit sections 76a and 76b, through valve body inlet passage 158 and valve vent port 164 to vent passage 156 and vent conduit 80, thus rapidly lowering the pressure in control cavity 74 to substantially atmospheric pressure.

Such release of pressure from control cavity 74, and hence from the top of injector needle 110, enables the upward force of hydraulic pressure in secondary accumulator cavity 130 against needle bevel 115 to overcome the downward force of needle spring 142 and lift the needle off of valve seat 108 to cause an injection event to occur. Injection will then continue until pressure in the combined accumulator cavities 126 and 130 is reduced to the point where it is overcome by the downward force of needle spring 142 which then closes the needle against valve seat 108 in preparation for another cycle of operation of injector 44. FIGS. 1–4 show reciprocating pump plunger 50 at its bottom dead center position (BDC), at the lowest point on eccentric cam lobe 48. Upward movement of plunger 50 from this point, caused by rotation of cam lobe 48, will be considered the initiation of an injection cycle. Plunger cavity 52 has been filled with fuel supplied through intake conduit 56 and check valve 58 during the preceding downstroke of plunger 50. As plunger 50 moves upwardly it compresses fuel in plunger cavity 52, high pressure output conduit or fuel supply conduit 60, accumulator cavity feed conduit 62, and through accumulator check valve 70 into primary accumulator cavity 126, through channels 128 into secondary accumulator cavity 130 and outlet cavity 132. At the same time, fuel pressure from the rising plunger 50 is applied from conduit 60 through control cavity feed conduit 64, adjustable orifice 72 and feed conduit continuation 64a in plug 38 to control cavity 74, this rising pressure being simultaneously applied through control cavity high pressure outlet conduit sections 76a and 76b and solenoid valve high pressure inlet passage 158 to high pressure solenoid valve cavity 160, the closed solenoid valve 78 holding the rising pump pressure within the aforesaid hydraulic system in engine head 16.

Before pump plunger 50 reaches its TDC position on cam lobe 48, pump output pressure relief valve 66 will open to the extent required to establish a predetermined pressure (2000 psi in the illustrated embodiment) within the entire hydraulic system pressurized by high pressure pump 46. That predetermined pressure will be retained by accumulator check valve 70 within the accumulator cavities until an injection event is precipitated by opening of solenoid valve 78 at time BDC, in FIG. 5.

3. Fuel Injection Quantity Control

Figure 6A:
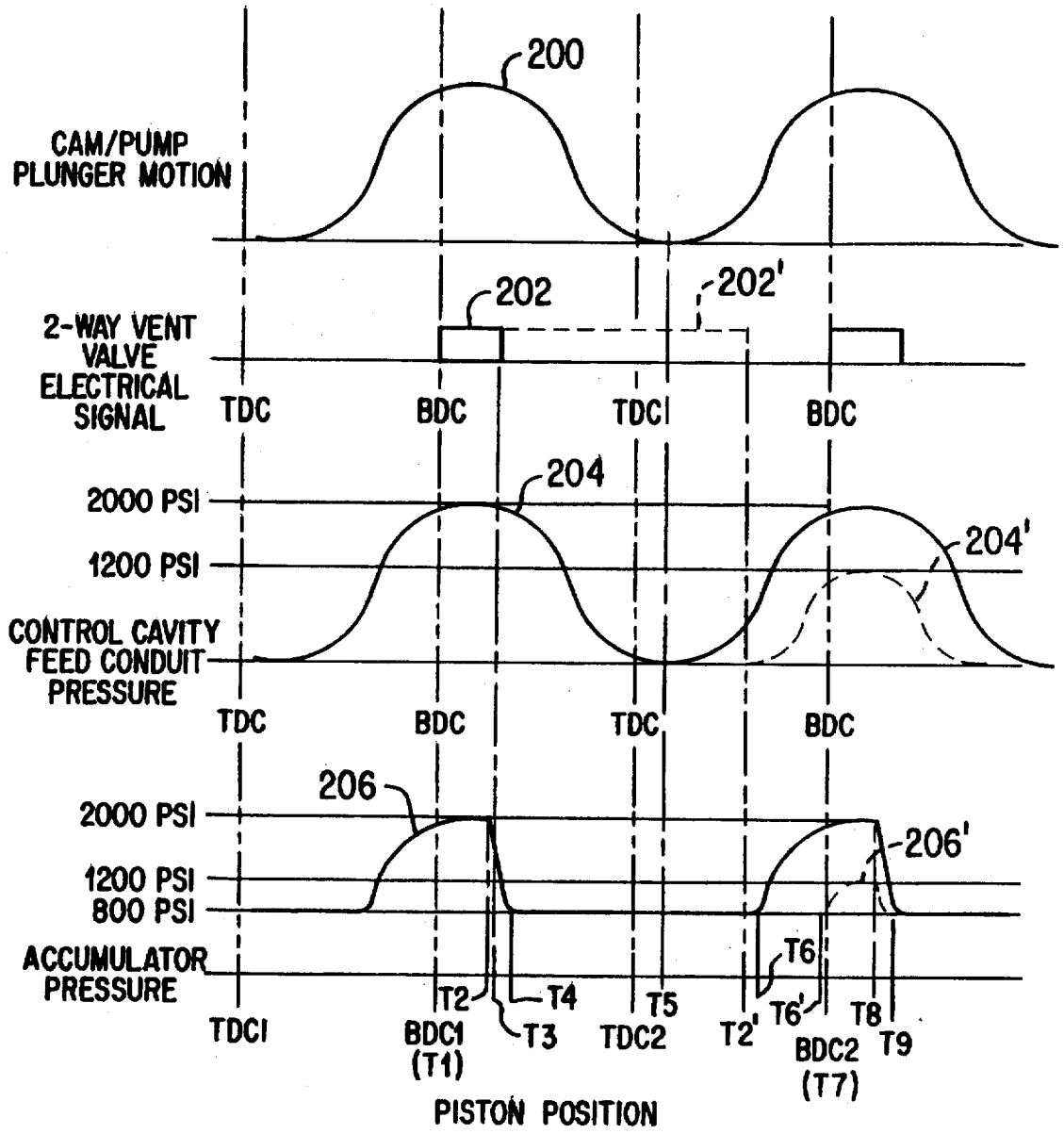
FIGS. 6A and 6B collectively form a histogram illustrating the effects of the inventive fuel metering scheme on the engine of FIGS. 1–5.
Figure 6B:
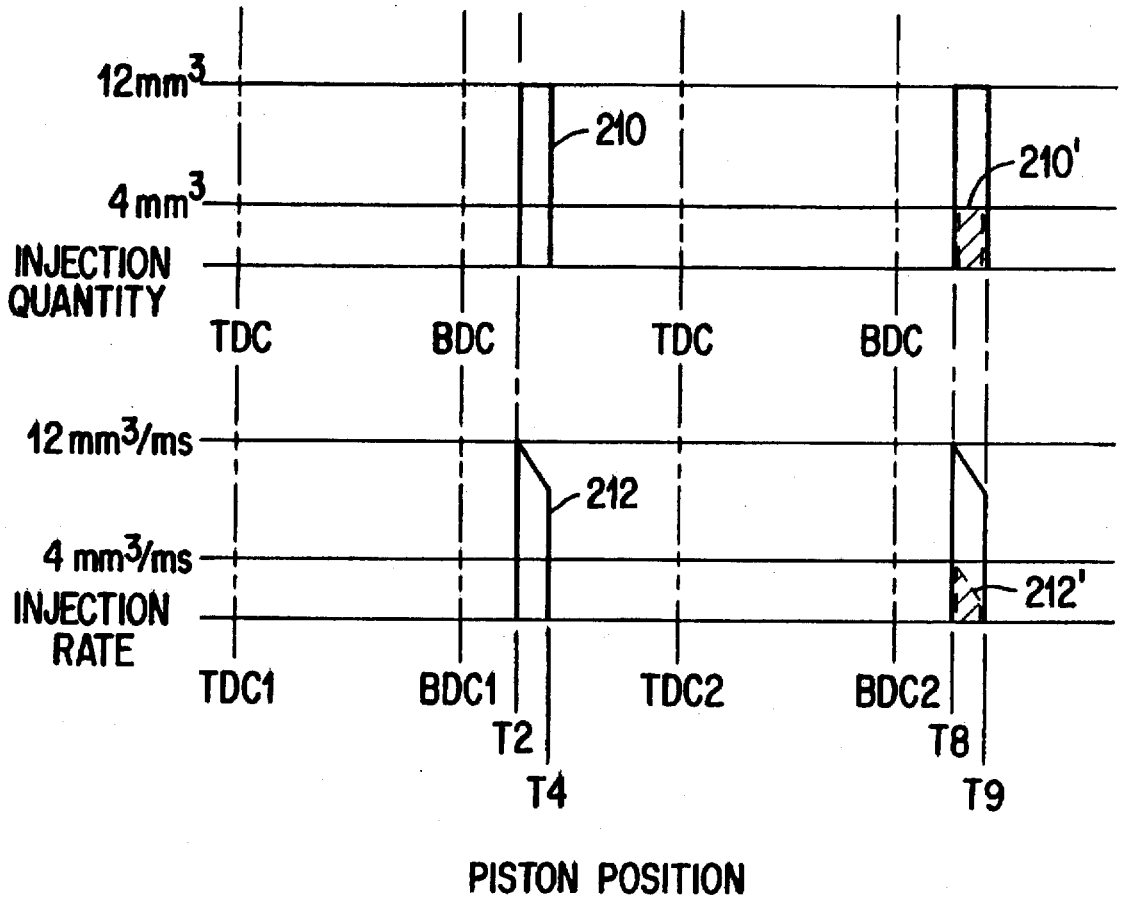

The manner in which an accumulator type fuel injection system of the disclosed type operates under a full load condition, without using the solenoid vent valve 78 to control peak accumulator pressure and fuel injection quantity, can be appreciated with reference to the portions of the histograms extending from times TDC1 to and beyond BDC1 of FIGS. 6A and 6B. Curve 200 represents cam or pump plunger motion as the pump plunger 50 cyclically effects pressurization and depressurization strokes. Curve 202 illustrates that, assuming the valve 78 is closed, the pressure in the control cavity feed conduit 64 varies proportionally with cam or pump plunger motion from a minimum of essentially 0 psi to a maximum of 2000 psi. Curve 204 illustrates that the pressure in accumulator cavity 126 rises to the same maximum value, i.e., 2000 psi, from a minimum value of 800 psi representing the needle closing pressure. When the solenoid valve 78 is open at time T1, control cavity pressure vents rapidly through the valve 78 and conduit 76, resulting in needle lift and initiation of an injection event at time T2. (A corresponding rapid pressure decrease does not occur in the control cavity feed conduit 64 or fuel supply conduit 60 at this time due to the presence of orifice 72 in FIGS. 4 and 5). Injection continues until time T4 when pressure in the accumulator cavity 126 decays to a point at which the lifting forces imposed on the needle 110 by that pressure are overcome by the return forces imposed by the spring 142 and the relatively low fluid pressure in the control cavity 74. Curves 206 and 208 illustrate that, in the illustrated exemplary embodiment, 12 $mm^3$ of fuel are injected during the injection event at a peak injection rate of 12 $mm^3$ per millisecond. This maximum quantity and peak rate represent a quantity and rate that would occur in every fueling cycle of the engine but for the imposition of some fuel metering scheme.

The engine and fuel injection system as thus far described are for the most part identical to those described in the '968 patent, which is hereby incorporated by reference in its entirety.

The '968 patent also discusses control of engine load by skip-firing as well as control of maximum accumulator pressure through adjustment of injection timing, setting of relief valve pressure, and controlling a supply transfer pump pressure. As discussed above, all of these techniques, though effective, have inherent drawbacks and disadvantageous.

As will be appreciated from the foregoing and from a reading of the '968 patent, fuel injection quantity is directly proportional to the maximum pressure $P_{MAX}$ obtained in the accumulator cavity 126 during an injection event. As one might also appreciate from the foregoing description, fuel pressure cannot rise in the accumulator cavity 126 so long as the solenoid vent valve 78 is open because fuel would merely flow from the pump plunger cavity 82, through the fuel supply conduit 60, and out of the injector through the valve 78 and outlet conduit 76. It has been discovered that these characteristics of the system can be used to provide a new and alternate method of fuel metering making use of the two way solenoid vent valve 78 already included for the purpose of initiating the injection event.

Specifically, since the primary purpose of the valve 78 is to open a passage 76 to vent the control cavity 74 to the low pressure return line 76, this valve can also be allowed to remain open for a substantially longer period of time than is required to vent the control cavity 74 and initiate an injection event in order to delay the initiation of the pumping pressure rise during the subsequent injection cycle. By effectively "wasting" a portion of the pump motion by allowing the fuel to pass directly through the solenoid vent valve 78, the pressure developed during the controlled pumping cycle is reduced to a level that is less than the maximum pressure that would normally be achieved if the solenoid vent valve 78 were closed immediately after the preceding vent cycle. Since injection quantity in the disclosed accumulator-type injector is directly proportional to the maximum pressure in accumulator cavity 126, fuel injection quantity can be adjusted for each cycle of engine operation by suitably adjusting peak accumulator pressure through the suitable control of the solenoid vent valve 78. This control of fuel delivery can be varied from part load to full load, thus avoiding several compromises related to the previously known pressure control method discussed above.

Referring to how the phantom line of curves 202', 204', 206', and 208' in FIGS. 6A and 6B, peak accumulator cavity pressure $P_{MAX}$ and consequent peak injection rate and injection quantity can be reduced by extending the time that the valve 78 remains open during a controlled injection cycle beginning at pump plunger position TDC2 and extending through BDC2. Hence, when the open period of the solenoid vent valve 78 is extended to time T2', pressure rise in the control cavity feed conduit 64 and the accumulator cavity 126, which would normally begin at time T6, is delayed until time T6' and thereafter generally lags behind pump plunger motion. Pressure in the control cavity feed conduit 64 and the accumulator cavity 126 therefore peak at a level substantially below the maximum obtainable level. Since peak injection rate and injection quantity are directionally proportional to $P_{MAX}$, the peak injection rate and resultant injection quantity are also reduced as illustrated by the curves 208' and 210'. In the illustrated example in which the valve 78 closes at the time T3', accumulator pressure peaks at 1200 psi, as illustrated by the curve 206', resulting in a peak injection rate of 4 $mm^3$ per millisecond at an injection quantity of 4 $mm^3$ as represented by the curves 210' and 208' respectively. It should be noted that the periods and pressures are exemplary only and that the peak accumulator cavity pressure and the resulting peak injection rate and injection quantity in each injection event vary generally inversely with the time for which the solenoid valve 78 is closed during the pump plunger pressurization stroke.

In practice, the ECU 90 would control the valve 78, using data from engine load sensors and other appropriate sensors, to achieve valve closure at a time optimizing fuel delivery quantity for prevailing engine operating conditions. Hence, the solenoid valve 78 could be closed 1) at any point before initiation of the pressurization stroke of the plunger 50, i.e., before time T5 in drawing 6A, to permit full accumulator cavity pressurization and resulting maximum fuel quantity delivery; 2) after the time T7 at which it would normally be opened to trigger the next injection event, in which case accumulator cavity pressure would not rise beyond its minimum pressure of 800 psi and the injection event would be skipped entirely, resulting in skip-firing; or 3) at any desired point during the pump pressurization stroke, resulting in delivery of an intermediate quantity of fuel.

The fuel metering scheme as thus far described assumes that the solenoid vent valve 78 is of the non-latching type, i.e., is biased into its closed position so as to require solenoid energization at all times that the valve is open. Hence, referring to FIG. 6A, the solenoid must remain energized during the entire period T1 to T2 to maintain the valve 78 in its open state. The supply of current to the solenoid for this relatively prolonged period is of little concern in applications in which electrical power for the engine is supplied by a battery and in which alternator size is of no concern. However, in leaf blowers, weed trimmers, and other applications lacking a battery and receiving electrical power only through a magneto, or even in applications having a battery but in which the alternator must be as small as possible, maintaining current flow to the solenoid for any significant period of time could constitute an undesirable power drain on the engine's electrical system. This potential drawback can be avoided by using as the solenoid valve a latching type valve.

As is known by those skilled in the art of solenoid valves, a latching type solenoid valve is one which is energized from a first state to a second state upon receipt of a first, short current pulse and remains in that state until a second current pulse is received, at which time it switches back to the first state. Hence, if the illustrated valve 78 were to be of the latching type, opening the valve at time T1 would require the transmission of a relatively short current pulse to the solenoid, whereafter the solenoid would remain de-energized and the valve would remain in its open state until time T2 when a second relatively short current pulse is supplied to close the valve 78. Aggregate electrical energy consumption for valve energization therefore would be substantially reduced when compared to a non-latching type valve, reducing the electrical power drain on the engine.

As can be appreciated from the foregoing description, by effectively "wasting" a portion of the pressurization stroke of the pump plunger 50 by allowing the fuel to pass directly through the solenoid vent valve 78 and return line 76, the pressure developed during the controlled pumping cycle is reduced to a level that is less than the maximum pressure which would normally be achieved if the valve 78 were closed immediately after the preceding control cavity venting cycle. Unlike load control by skip-fire, injection quantity control is very precise, being generally inversely proportional to the percentage of the pump pressurization stroke that is wasted. Moreover, unlike heretofore available techniques for controlling the maximum accumulator pressure $P_{MAX}$ at the moment of injection, the inventive fuel metering apparatus and method 1) do not adversely affect injection timing, 2) can provide for fuel delivery control under engine part-load conditions, and 3) do not require any additional equipment such as a low pressure pump to be incorporated into the system.

Many changes and modifications could be made to the invention without departing from the spirit thereof. For instance, the invention is usable with any of the fuel injector configurations described in the '968 patent as well as various other accumulator and hybrid type injectors in which the quantity of fuel injected during an injection event is directly proportional to $P_{MAX}$. The scope of these changes will become apparent from the appended claims.

We claim:

1. A method comprising (A) providing a two-cycle engine comprising a cylinder and an accumulator-type fuel injector arranged to inject fuel directly into said cylinder, said fuel injector having a needle normally spring-biased downwardly to a closed position, an accumulator cavity located so as to impose an upward opening force on said needle when pressurized, and a control cavity located so as to impose a downward closing force on said needle when pressurized;

(B) substantially simultaneously pressurizing said accumulator and control cavities with fuel through respective accumulator cavity and control cavity feed conduits to about the same pressure level above that which would be sufficient for the upward force of accumulator pressure on said needle to overcome said spring biasing but for the downward force of control cavity pressure on said needle, said pressurizing step comprising mechanically reciprocating a high pressure fuel pump plunger in a first direction;

(C) at least partially depressurizing said accumulator cavity feed conduit while preventing unrestricted return fuel flow through said accumulator cavity feed conduit from said accumulator cavity, said depressurizing step comprising mechanically reciprocating said high pressure fuel pump plunger in a second direction;

(D) opening a two-way solenoid-actuated solenoid vent valve located in fluid communication with said control cavity, thereby venting fuel pressure from said control cavity so that said upward force of accumulator pressure on said needle overcomes all downward forces on said needle and raises said needle to an open position for injection of fuel from said accumulator injector directly into the cylinder, then lowering said needle to a closed position to terminate fuel injection when downward forces imposed on said needle overcome said upward force of accumulator pressure imposed on said needle;

(E) maintaining said solenoid vent valve in its open position;

(F) while said solenoid vent valve is in its open position, mechanically reciprocating said high pressure fuel pump plunger in said first direction to force fuel through said vent passage without pressurizing said accumulator cavity or said control cavity;

(G) closing said solenoid vent valve to prevent further fluid flow through said vent passage; then (H) continuing to mechanically reciprocate said high pressure pump plunger in said first direction, thereby substantially simultaneously pressurizing said accumulator and control cavities with fuel through said accumulator and control cavity feed conduits to a peak pressure level below a peak pressure level obtained during the step (B); then (I) mechanically reciprocating said high pressure fuel pump plunger in said second direction to at least partially depressurize said accumulator cavity feed conduit while preventing unrestricted return fuel flow through said accumulator cavity feed conduit from said accumulator cavity; and (J) opening said solenoid vent valve, thereby venting fuel pressure from said control cavity so that said upward force of accumulator pressure on said needle overcomes all downward forces on said needle and raises said needle to said open position for injection of fuel from said accumulator injector directly into the cylinder, wherein a total quantity of fuel injected during the step (J) is smaller than a total quantity of fuel injected during the step (D).

2. The method as defined in claim 1, wherein said providing step comprises placing a flow-restricting orifice in said control cavity feed conduit so that fuel inflow through said control cavity feed conduit during control cavity venting does not interfere with solenoid vent valve venting of said control cavity.

3. The method of claim 1, wherein said providing step comprises placing a check valve in said accumulator cavity feed conduit, so that the highest pump output pressure received will be retained in said accumulator cavity until venting of said control cavity by said solenoid vent valve, if said venting step is timed to occur proximate or after pressure in said accumulator cavity has risen to said highest pressure.

4. A method as defined in claim 1, wherein, during the step (J), the total quantity of fuel injected and a peak rate of fuel injection vary generally inversely with the duration of the step (F).

5. A method as defined in claim 1, wherein the step (J) occurs prior to the step (I).

6. method comprising:

(A) providing an engine comprising (1) a cylinder, (2) a fuel injector arranged to inject fuel into said cylinder, said injector having a) a needle spring-biased downwardly to a closed position and b) a pressurizeable cavity, and (3) a pump having an input and having an output fluidically coupled to said cavity by a fuel supply conduit;

(B) reciprocating said pump to undergo successive pumping cycles, each said pumping cycle consisting of a pressurization stroke followed by a depressurization stroke, and wherein said pump forces fuel into said fuel supply conduit and said cavity during pressurization strokes thereof and permits backflow from said fuel supply conduit towards said output during depressurization strokes thereof;

(C) initiating a first injection event occurring as a result of a first pumping cycle by venting said cavity; and (D) selecting the quantity off fuel injected during a second injection event occurring as a result of a second pumping cycle, occurring immediately following said first pumping cycle, by continuing to vent said cavity for a designated portion of the pressurization stroke of said second pumping cycle, said designated portion 1) including a time at which said pressurization stroke begins and 2) varying generally inversely with a quantity of fuel to be injected during the second injection event.

7. A method as defined in claim 6, wherein said venting step comprises energizing a solenoid of a solenoid vent valve, disposed in an outlet conduit in fluid communication with said cavity, to open said solenoid vent valve and permits fuel flow therethrough.

8. A method as defined in claim 7, wherein said solenoid vent valve is a non-latching solenoid valve, and further comprising maintaining current flow to the solenoid of said valve for the entire time that said valve is open and then de-energizing said solenoid to close said valve at the end of said designated portion.

9. A method as defined in claim 7, wherein said solenoid vent valve is a latching solenoid valve, wherein said energizing step comprises supplying a current pulse to the solenoid of said valve, and wherein said valve remains open after termination of said current pulse, and further comprising closing said valve at the end of said designated portion by supplying a second current pulse to said solenoid.

10. A method as defined in claim 6, wherein the providing step comprises providing an accumulator type injector 1) in which said cavity is a control cavity located so as to impose a downward biasing force on said needle when said control cavity is pressurized, and 2) which includes an accumulator cavity in at least one-way fluid communication with said fuel supply conduit and which is located so as to impose an upward opening force on said needle when said accumulator cavity is pressurized.

11. A method as defined in claim 6, wherein the providing step comprises providing said pump with a reciprocating plunger driven by a crankshaft of said engine.

12. An apparatus for supplying fuel to an engine having a cylinder and a crankshaft, said apparatus comprising:

(A) a fuel injector, said fuel injector including (1) an injector body having a pressurized fuel inlet and having a discharge orifice communicating with said cylinder;

(2) a nozzle needle slidably disposed in said nozzle body and being spring biased towards a position preventing fuel flow out of said discharge orifice;

(B) a fuel supply conduit in fluid communication with said pressurized fuel inlet of said injector body and having an inlet;

(C) a reciprocating pump which has an input operatively connected to said fuel source and which has an output connected to said inlet of said fuel supply conduit, wherein said pump operates in pumping cycles with each pumping cycle consisting of a pressurization stroke followed by a depressurization stroke, and wherein said pump forces fuel into said fuel supply conduit during pressurization strokes thereof and permits backflow from said fuel supply conduit towards said output during depressurization strokes thereof;

(D) a solenoid vent valve which is in fluid communication with said fuel supply conduit and with vent and which, when energized, places said fuel supply conduit in fluid communication with vent; and (E) means for 1) opening said solenoid vent valve to initiate a first injection event occurring as a result of a first pumping cycle and for 2) maintaining said solenoid vent valve in the open position for a designated portion of a pressurization stroke of a second pumping cycle occurring immediately following said first pumping cycle, said designated portion including the beginning of said pressurization stroke and varying generally inversely with a quantity of fuel to be injected during a second injection event occurring as a result of said second pumping cycle.

13. An apparatus as defined in claim 12, wherein said solenoid vent valve is a two-way valve.

14. A method as defined in claim 13, wherein said solenoid vent valve is a nonlatching solenoid valve, and wherein said means supplies a current to the solenoid of said valve to open said valve and maintains current flow to said solenoid for the entire time that said valve is open and then terminates the supply of current to said solenoid at the end of said designated portion to close said valve.

15. A method as defined in claim 13, wherein said solenoid vent valve is a latching solenoid valve, wherein said means supplies a current pulse to said solenoid to open said valve, wherein said valve remains open after termination of said pulse, and wherein said means supplies a second current pulse to said solenoid at the end of said designated portion to close said valve.

16. An apparatus as defined in claim 12, wherein said fuel injector is an accumulator-type fuel injector having an accumulator cavity in fluid communication with said fuel inlet of said fuel injector and having a control cavity, said accumulator cavity being located so that fuel pressure therein imposes an opening force on said needle, said control cavity being located so that fuel pressure therein imposes a closing force on said needle, and further comprising an outlet conduit in fluid communication with said control cavity, said solenoid vent valve, and said fuel supply conduit.

17. An apparatus as defined in claim 16, wherein said control cavity has a first opening and has a second opening connected to said outlet conduit, and further comprising an accumulator cavity feed conduit connecting said inlet of said fuel injector to said fuel supply conduit; and a control cavity feed conduit connecting said first opening of said control cavity to said fuel supply conduit.

18. An apparatus as defined in claim 12, wherein said means comprises an electronic control unit.

19. A two-cycle internal combustion engine, which comprises:

(A) a cylinder;

(B) a crankshaft;

(C) an accumulator-type fuel injector mounted in the two-cycle engine and arranged to inject fuel directly into said cylinder, said injector having a needle normally spring-biased downwardly to a closed position, an accumulator cavity located so as to impose an upward opening force on said needle when pressurized, and a control cavity located so as to impose a downward closing force on said needle when pressurized;

(D) a fuel source;

(E) a reciprocating high pressure fuel pump which is driven by said crankshaft, which has an input operatively connected to said fuel source, and which has an output;

(F) a fuel supply conduit connected to said output of said pump;

(G) an accumulator cavity feed conduit in fluid communication with said accumulator cavity and said fuel supply conduit;

(H) a control cavity feed conduit in two-way fluid communication with said fuel supply conduit and with said control cavity, wherein said pump operates in cycles with each pumping cycle consisting of a pressurization stroke followed by a depressurization stroke, and wherein said pump forces fuel into said fuel supply conduit and said control cavity during pressurization strokes thereof and permits backflow from said fuel supply conduit towards said output during depressurization strokes thereof;

(I) an outlet conduit in fluid communication with said control cavity and with vent;

(J) a two-way/two-position solenoid vent valve disposed in said outlet conduit and being closed when de-energized; and (K) an electronic control unit in electronic communication with said solenoid vent valve, said electronic control unit controlling said solenoid vent valve such that said solenoid vent valve remains energized during at least a portion of a depressurization stroke of a first pumping cycle and a designated portion of a pressurization stroke of a second pumping cycle occurring immediately after said first pumping cycle, wherein said designated portion is generally inversely related to a quantity of fuel to be injected as a result of an injection event occurring during said second pumping cycle.

* * * * *